US010332714B2

(12) United States Patent
Oh

(10) Patent No.: US 10,332,714 B2
(45) Date of Patent: Jun. 25, 2019

(54) TRIP MECHANISM FOR DIRECT CURRENT MOLDED CASE CIRCUIT BREAKER

(71) Applicant: LSIS CO., LTD., Anyang-si, Gyeonggi-do (KR)

(72) Inventor: Kihwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 125 days.

(21) Appl. No.: 15/644,447

(22) Filed: Jul. 7, 2017

(65) Prior Publication Data

US 2018/0061602 A1 Mar. 1, 2018

(30) Foreign Application Priority Data

Aug. 31, 2016 (KR) ..... 10-2016-0112031

(51) Int. Cl.
*H01H 71/40* (2006.01)
*H01H 71/02* (2006.01)
(Continued)

(52) U.S. Cl.
CPC ..... *H01H 71/40* (2013.01); *H01H 71/02* (2013.01); *H01H 71/1009* (2013.01);
(Continued)

(58) Field of Classification Search
CPC ..... H01H 1/40; H01H 71/02; H01H 71/1009; H01H 71/164; H01H 71/2472; H01H 71/08; H01H 2009/008; H01H 2235/01
See application file for complete search history.

(56) References Cited

U.S. PATENT DOCUMENTS 2,043,306 A * 6/1936 Sandin ..... H01H 71/164 335/145
2,089,716 A * 8/1937 Smith ..... H01H 71/40 335/23
(Continued)

FOREIGN PATENT DOCUMENTS

CN 101527227 A 9/2009
CN 104779129 A 7/2015
(Continued)

OTHER PUBLICATIONS

Google translation for WO 2007090820 A1.*
(Continued)

*Primary Examiner* — Mohamad A Musleh
(74) *Attorney, Agent, or Firm* — K&L Gates LLP

(57) ABSTRACT

Provided is a trip mechanism for DC molded case circuit breaker, in which the insulating distance between the poles increases without any increase in whole product size, thereby reliably providing a trigger output against an over current and a fault current instantaneous breaking required. The trip mechanism includes a trip mechanism part including an instantaneous trip mechanism, the instantaneous trip mechanism including a movable member to operate according to a fault current instantaneous breaking required, and a thermal trip mechanism including a bimetal to operate according to an over current, the trip mechanism part being provided for one of two adjacent poles; a crossbar that is rotatable by contacting and pressing of the movable member of the instantaneous trip mechanism or the bimetal of the thermal trip mechanism; and a shooter that is provided to be rotatable by contacting of the crossbar rotating.

12 Claims, 14 Drawing Sheets

(51) Int. Cl.

| | |
|---|---|
| ***H01H 71/16*** | (2006.01) |
| ***H01H 71/24*** | (2006.01) |
| ***H01H 71/10*** | (2006.01) |
| *H01H 71/08* | (2006.01) |
| *H01H 9/00* | (2006.01) |

(52) U.S. Cl.
CPC ..... *H01H 71/164* (2013.01); *H01H 71/2472* (2013.01); *H01H 71/08* (2013.01); *H01H 2009/0088* (2013.01); *H01H 2235/01* (2013.01)

(56) References Cited

U.S. PATENT DOCUMENTS

| | | | | |
|---|---|---|---|---|
| 2,981,811 | A * | 4/1961 | Steven | H01H 71/40 335/157 |
| 5,872,495 | A * | 2/1999 | DiMarco | H01H 71/164 335/22 |
| 6,184,763 | B1 * | 2/2001 | DeGrazia | H01H 71/0264 335/172 |
| 2009/0224864 | A1 | 9/2009 | Tetik | |
| 2012/0138442 | A1 | 6/2012 | Beatty et al. | |
| 2015/0380189 | A1 | 12/2015 | He | |
| 2016/0042887 | A1 | 2/2016 | Bertrand | |

FOREIGN PATENT DOCUMENTS

| | | | | |
|---|---|---|---|---|
| CN | 104810216 | A | 7/2015 | |
| CN | 105719918 | A | 6/2016 | |
| DE | 3219368 | A1 | 12/1982 | |
| JP | S5954142 | | 3/1984 | |
| JP | 2004227905 | | 8/2004 | |
| JP | 2008060049 | | 3/2008 | |
| JP | 2011124217 | | 6/2011 | |
| JP | 2016134361 | | 7/2016 | |
| KR | 200390554 | | 7/2005 | |
| KR | 100652236 | | 11/2006 | |
| KR | 20130002626 | | 5/2013 | |
| KR | 101437568 | | 9/2014 | |
| KR | 101487258 | | 1/2015 | |
| KR | 20150044746 | | 4/2015 | |
| KR | 2020160002213 | | 6/2016 | |
| WO | WO-2007090820 | A1 * | 8/2007 | H01H 71/40 |

OTHER PUBLICATIONS

Chinese Office Action for related Chinese Application No. 201710730781.3; action dated Sep. 25, 2018; (13 pages).
Korean Intellectual Property Office Application No. 10-2016-0112031, Office Action dated Jul. 12, 2017, 6 pages.
Korean Intellectual Property Office Search report dated Sep. 13, 2016, 3 pages.
European Search Report for related European Application No. 17180014.7; report dated Jan. 24, 2018 (11 pages).

* cited by examiner

TRIP MECHANISM FOR DIRECT CURRENT MOLDED CASE CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2016-0112031, filed on Aug. 31, 2016, the contents of which are all hereby incorporated by reference herein in its entirety.

BACKGROUND OF THE DISCLOSURE

1. Field of the Disclosure

The present disclosure relates to a direct current (DC) molded case circuit breaker (hereinafter referred to as a molded case circuit breaker), and particularly, to a trip mechanism for DC molded case circuit breaker for enlarging an insulating distance between poles.

2. Background of the Disclosure

The related art trip mechanism for molded case circuit breaker will be described with reference to the following patent document allowed to the applicant.

(Patent Document 1) KR10-0652236 B1

In the related art trip mechanism for molded case circuit breaker, a trip mechanism is provided in each pole (phase), and an electrical insulating distance {i.e., an insulating distance between poles (phases)} between trip mechanisms for adjacent poles (phases) is not considered.

A DC molded case circuit breaker is a molded case circuit breaker which includes a positive pole and negative pole for an electric power source side and a positive pole and a negative pole for an electric load side, which are used for the switching and protection of a DC circuit, and is differentiated from an alternating current (AC) molded case circuit breaker having circuit switching configurations for three phases such as an R phase, an S phase, and a T phase or for four phases such as an R phase, an S phase, a T phase, and an N phase, which are provided in an electric power source side and an electric load side.

In the DC molded case circuit breaker, it is required for an insulating distance between poles to increase in proportion to an increase in each of a service voltage and an insulation voltage.

However, the increase in the insulating distance between the poles causes an increase in a whole product size of the DC molded case circuit breaker, and thus, it is required to develop a DC molded case circuit breaker in which as the service voltage and the insulation voltage increase, the insulating distance between the poles increases without any increase in whole product size.

Moreover, it is required to develop a trip mechanism for DC molded case circuit breaker, which reliably provides a trigger output against an over current and a fault current instantaneous breaking required.

SUMMARY OF THE DISCLOSURE

Therefore, an object of this disclosure is to provide a trip mechanism for DC molded case circuit breaker, in which as a service voltage and an insulation voltage increase, the insulating distance between the poles increases without any increase in whole product size.

Another object of this disclosure is to provide a trip mechanism for DC molded case circuit breaker, which reliably provides a trigger output against an over current and a fault current instantaneous breaking required.

To achieve these and other advantages and in accordance with the purpose of this disclosure, as embodied and broadly described herein, a trip mechanism for direct current (DC) molded case circuit breaker, the trip mechanism comprising: a trip mechanism part including an instantaneous trip mechanism connected to a circuit, the instantaneous trip mechanism including a movable member to operate according to a fault current instantaneous breaking required which flows on the circuit, and a thermal trip mechanism connected to the circuit, the thermal trip mechanism including a bimetal to operate according to an over current flowing on the circuit, the trip mechanism part being provided for one of two adjacent poles; a crossbar that is rotatable by contacting and pressing of the movable member of the instantaneous trip mechanism or the bimetal of the thermal trip mechanism; and a shooter that is provided to be rotatable by contacting of the crossbar rotating, the shooter provides an output of the trip mechanism.

According to one aspect of this disclosure, the crossbar comprises: a first power receiving portion that is provided in corresponding to the bimetal of the thermal trip mechanism, the first power receiving portion formed to protrude upwardly, and the first power receiving portion receiving a pressing force from the bimetal; a second power receiving portion that is provided in corresponding to the movable member of the instantaneous trip mechanism, the second power receiving portion formed to protrude upwardly, and the second power receiving portion receiving a pressing force from the movable member of the instantaneous trip mechanism; and an output protrusion portion that is provided to face the shooter and provided to upward protrude from the crossbar, the output protrusion portion providing an output of the crossbar which drives the shooter to rotate.

According to another aspect of this disclosure, the output protrusion portion is configured with an inclined surface facing the shooter, the inclined surface facing the shooter further protrudes toward the shooter in a downward direction.

According to still another aspect of this disclosure, the trip mechanism further comprises a return spring that returns the crossbar to an original position, wherein the crossbar further comprises a return spring supporting protrusion portion that is provided to extend downward, the return spring supporting protrusion portion supporting one end of the return spring.

According to still another aspect of this disclosure, the shooter comprises: a rotation shaft portion in a center; an output portion provided to be bent downward from the rotation shaft portion, the output portion providing an output of the shooter while rotating; and a power receiving portion provided to extend from the rotation shaft portion toward the crossbar, the power receiving portion being supplied with a rotational force from the crossbar.

According to still another aspect of this disclosure, the trip mechanism further comprises an enclosure; and a shaft receiving member that is provided as one body in the enclosure or provided as a separate body to be coupled to the enclosure, the shaft receiving member supporting the rotation shaft portion.

According to still another aspect of this disclosure, the thermal trip mechanism comprises: a heater that generates heat according to an over current occurring in the circuit, the heater being a terminal portion; and the bimetal coupled to the heater and bent by the heater generating the heat, and the instantaneous trip mechanism comprises: an electromagnet member electrically connected to the heater to provide a magnetic attractive force according to the fault current instantaneous breaking required of the circuit; an armature, the armature being a movable member capable of rotating to a position approaching the electromagnet member or a position deviating from the electromagnet member; and a torsion spring including one end contacting the armature, the torsion spring applying an elastic force, returning to a position deviating from the electromagnet member, to the armature.

According to still another aspect of this disclosure, the instantaneous trip mechanism further comprising a supporting plate, wherein the supporting plate comprises: a pair of side plate portions that include a shaft supporting portion supporting the rotation shaft; a connection portion that is fixed to the heater and connects the pair of side plate portions; and a pair of spring supporting portions that are provided to extend from the pair of side plate portions, the spring supporting portion supporting another end of the torsion spring.

According to still another aspect of this disclosure, the armature comprises: an armature output portion provided on a upper part of the armature to contact and press the crossbar while rotating; and a driving plate portion provided in a lower part of the armature as one body with the armature output portion and installed to face the electromagnet member to rotate to a position approaching the electromagnet member or a position deviating from the electromagnet member to rotate the armature output portion, the driving plate portion supporting one end of the torsion spring.

According to still another aspect of this disclosure, a terminal including an electrical conductor is provided in a pole, where the trip mechanism part is not installed, of two adjacent poles.

According to still another aspect of this disclosure, the trip mechanism further comprises an inter-pole insulation partition wall having a thickness equal to a distance between heaters for a pair of adjacent poles.

According to still another aspect of this disclosure, the trip mechanism further comprises a bus bar connected to a heater for each pole; and an inter-pole insulation plate provided between a pair of adjacent bus bars, for insulation between poles.

According to still another aspect of this disclosure, the trip mechanism part is provided as two in one DC molded case circuit breaker.

BRIEF DESCRIPTION OF THE DRAWINGS

The accompanying drawings, which are included to provide a further understanding of the disclosure and are incorporated in and constitute a part of this disclosure, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

In addition to the aforesaid objects of the present invention, other features and advantages of the present invention will be described below, but will be clearly understood by those skilled in the art from descriptions below.

Figure 1:
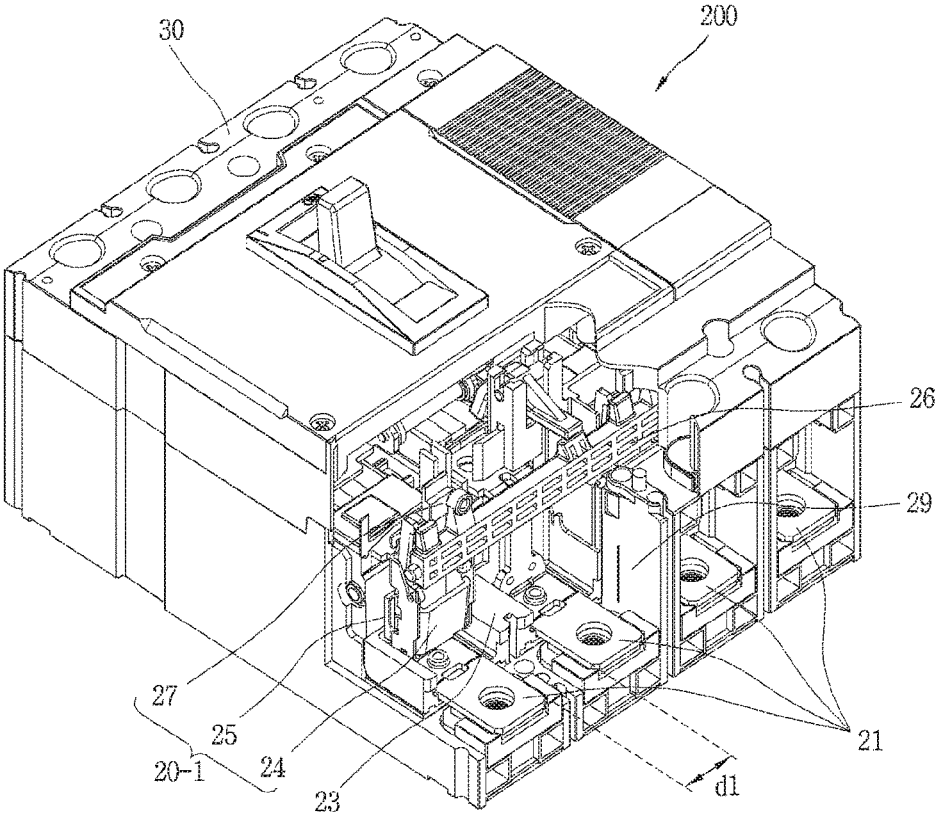
FIG. 1 is a partial cut-opened perspective view of a DC molded case circuit breaker showing a state where a trip mechanism according to an embodiment of the present invention is installed in a DC molded case circuit breaker.
Figure 2:
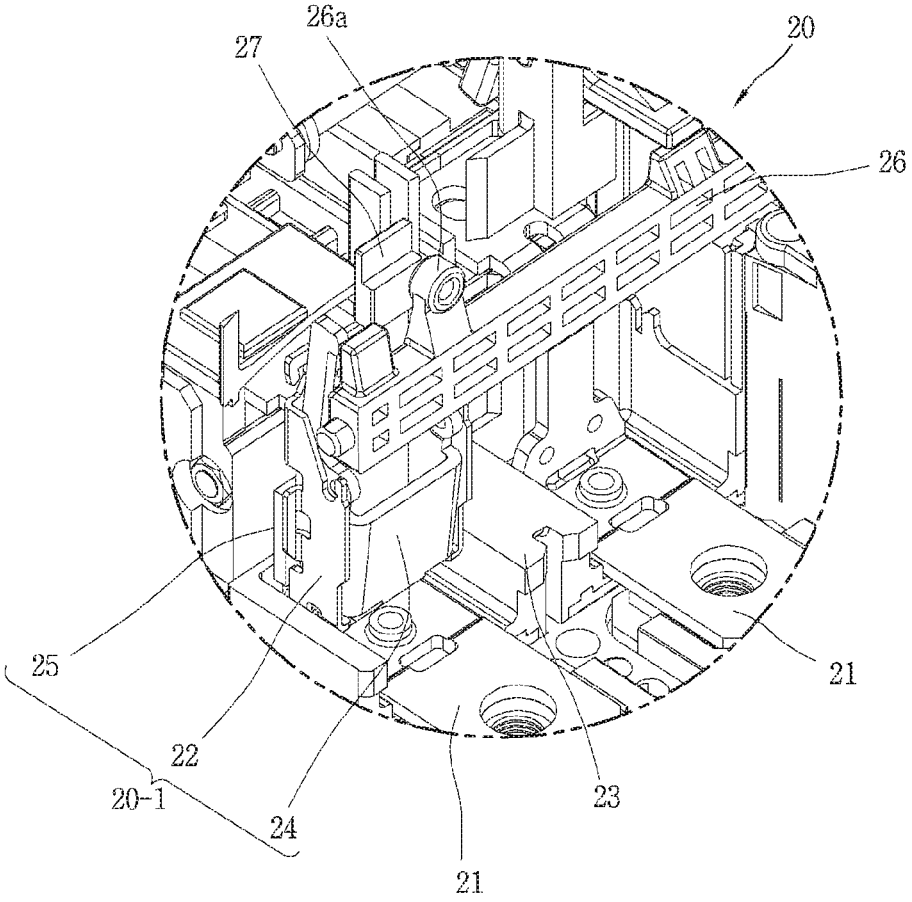
FIG. 2 is an enlarged view of only a trip mechanism in FIG. 1.
Figure 3:
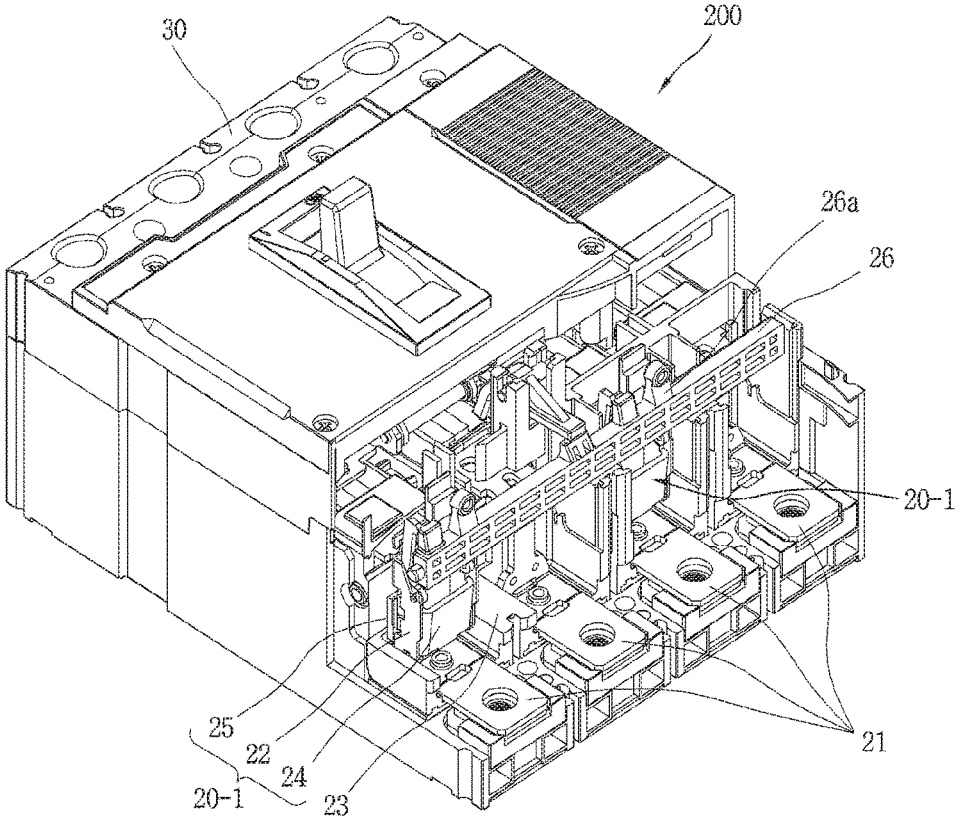
FIG. 3 is a partial perspective view of a DC molded case circuit breaker where an enclosure portion of an electric power source side or an electric load side is fully cut-opened, for showing a state where a trip mechanism according to an embodiment of the present invention is installed in a DC molded case circuit breaker.
Figure 7:
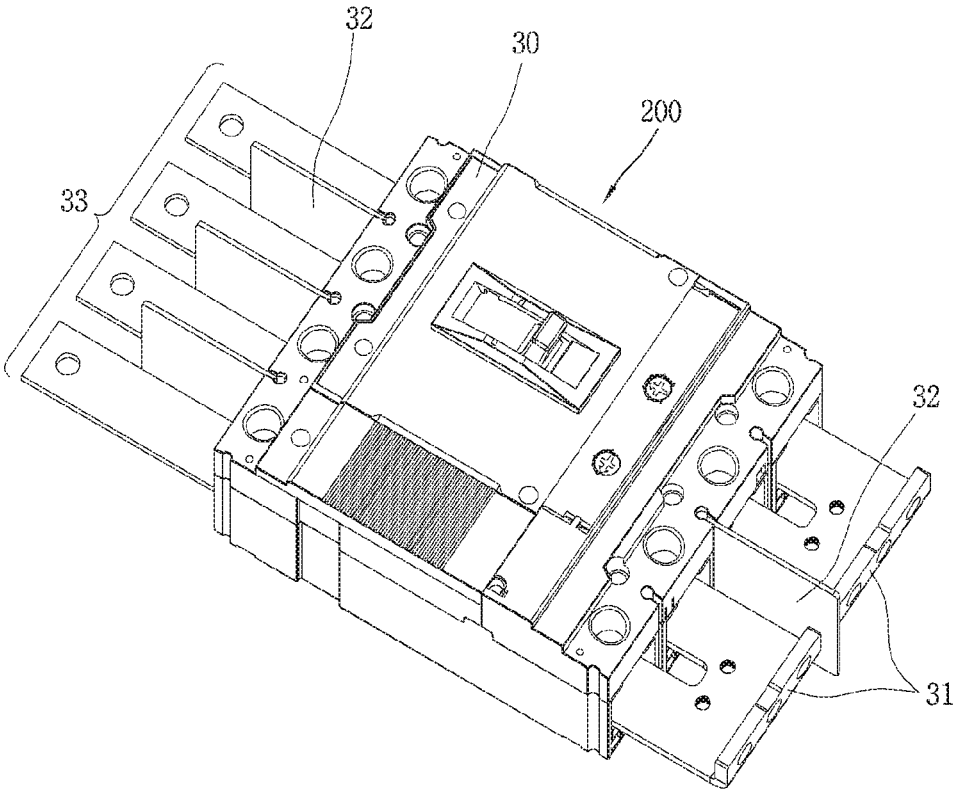
FIG. 7 is a perspective view showing a physical shape of a conductor connection member and a physical shape of a bus bar for a circuit connection in each of an electric power source side and an electric load side, in the DC molded case circuit breaker of FIG. 5.

As shown in FIGS. 1, 3, and 7, the DC molded case circuit breaker 200 according to a preferred embodiment of the present invention includes four terminal portions which are provided in both ends in a lengthwise direction. Here, each of the terminal portions can perform a function of a heater which provides a bimetal 27 with heat proportional to a current flowing on a circuit, and thus, may be referred to as a heater or a heater unit. Hereinafter, the terminal portion will be referred to as a heater in this disclosure and will be designated by reference numeral 21.

The DC molded case circuit breaker 200 includes a lower case, which is formed of an insulating material to accommodate internal elements and has a rectangular box shape with an upper portion opened, and an upper cover which covers the lower case.

In the upper cover, a terminal cover 30 which covers the heater 21 not to be externally exposed and thus prevents an electrical accident such as an electric shock or a short circuit may be installed just over the heaters 21.

A trip mechanism 20, a switching mechanism (not shown), and an arc extinguishing mechanism can be installed in the lower case.

The switching mechanism, as well known, is a mechanism which drives a movable contact to a closing position contacting a corresponding stationary contact and an opening position separated from the stationary contact, and may include a trip spring, a trip bar, a nail, a latch holder, a latch, a handle, a lever, links, and a shaft.

The trip mechanism 20 according to the present invention is a trip mechanism for DC molded case circuit breaker, and as well known, can be a mechanism which, when a fault current such as an over current or an electric shortage current flows on a circuit, detects the fault current and triggers the switching mechanism to operate to the opening position of the circuit.

The arc extinguishing mechanism, as well known, can be configured by stacking a plurality of grids near the movable contact and the stationary contact, and is a mechanism which quickly removes an arc occurring between the movable contact and the stationary contact when operating (for example, a trip operation or a manual off manipulation) to the opening position while a current is flowing.

Figure 4:
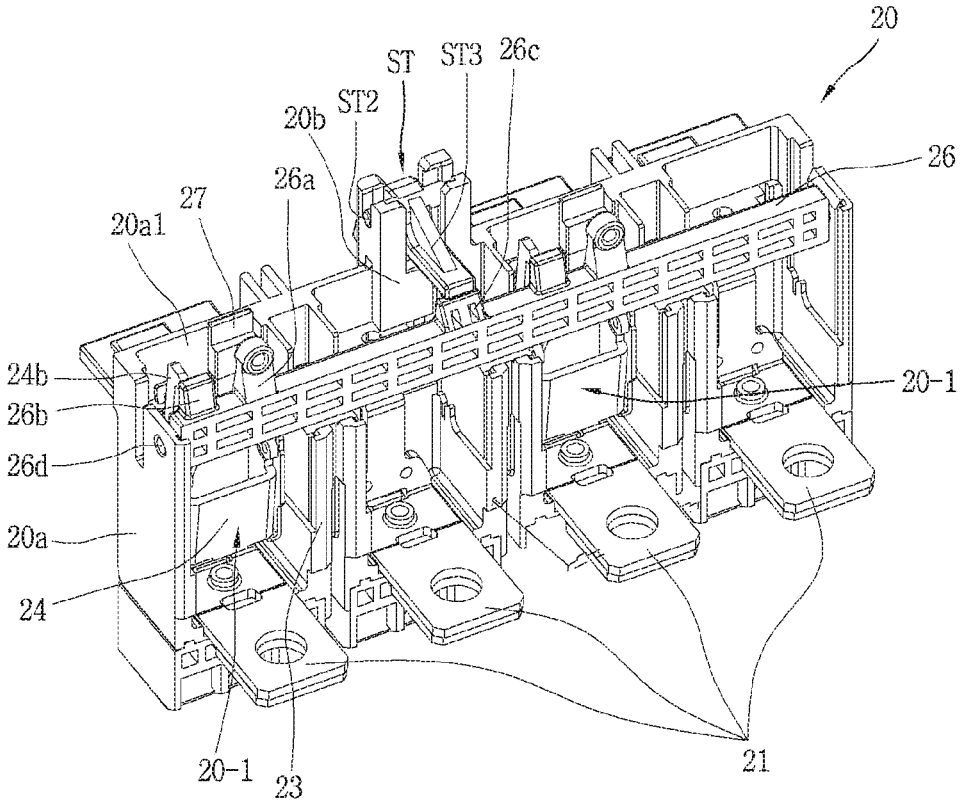
FIG. 4 is a perspective view separately showing only an assembly of a trip mechanism for DC molded case circuit breaker according to an embodiment of the present invention.
Figure 9:
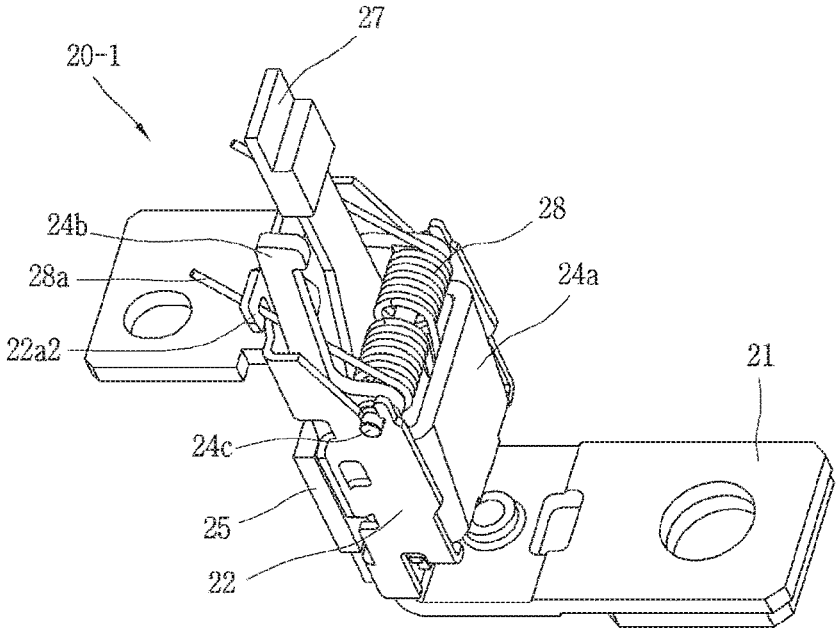
FIG. 9 is a perspective view when the trip mechanism part of FIG. 8 is diagonally seen from an upper side.
Figure 15:
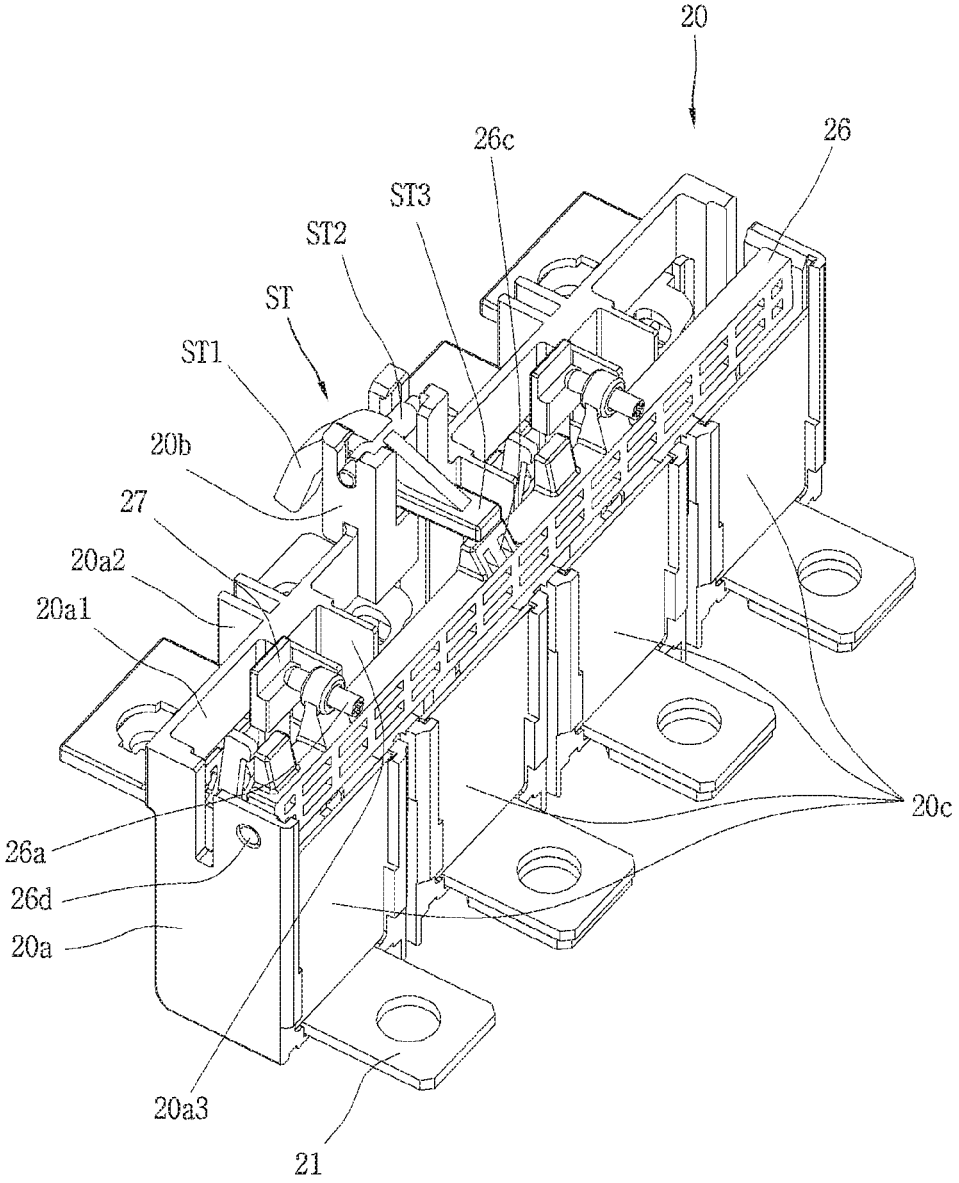
FIG. 15 is a perspective view showing only an assembly of a trip mechanism according to an embodiment of the present invention and is an operating state view showing a before-trip-operation state by an operation of a thermal trip mechanism.

A configuration of the trip mechanism 20 according to an embodiment of the present invention will be described with reference to FIGS. 4 and 15 showing an assembly of the trip mechanism 20 and FIG. 9 showing only a trip mechanism part.

The trip mechanism 20 according to an embodiment of the present invention may include a trip mechanism part (see 20-1 of FIG. 9), a crossbar (see 26 of FIGS. 4 and 15), and a shooter (see ST of FIGS. 4 and 15).

The trip mechanism part 20-1 includes an instantaneous trip mechanism 22, 24, 25, and 28 and a thermal trip mechanism 21 and 27.

As described with reference to FIGS. 1 to 6, the trip mechanism part 20-1 is provided for only one of two adjacent poles. Here, the two adjacent poles may denote poles which is physically closest to each other in the DC molded case circuit breaker, and as described with reference to FIGS. 5 and 6, may be the same positive poles or negative poles or may be different positive pole and negative pole.

The instantaneous trip mechanism 22, 24, 25, and 28 includes a plurality of movable members 24*a* and 24*b* which are connected to a circuit and operate according to an fault current instantaneous breaking required flowing in the circuit. Here, as well known, the fault current instantaneous breaking required is a fault current, which is several to tens times a rating current of the DC molded case circuit breaker as an electric shortage current, and may be a current which instantaneously requires breaking of the circuit.

Figure 8:
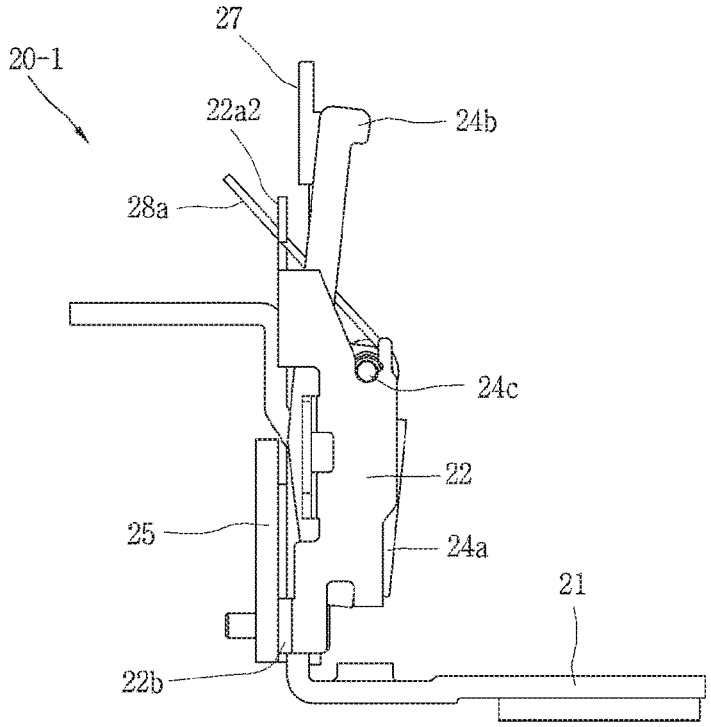
FIG. 8 is a side view separately showing only a trip mechanism part of a trip mechanism according to an embodiment of the present invention.

The instantaneous trip mechanism 22, 24, 25, and 28, as shown in FIG. 8 or 9, includes an electromagnet member 25, an armature 24, and a torsion spring 28.

The electromagnet member 25, a below-described terminal, can be fixed by a fixing means such as a screw or a rivet to a lower portion of a rear surface of a middle vertical portion of the heater 21. According to an embodiment, the electromagnet member 25 may be fixed to a portion under the rear surface of the middle vertical portion of the heater 21*b* y using a connection portion 22*b* of the below-described supporting plate 22.

The electromagnet member 25 is electrically connected to the heater 21 and provides a magnetic attractive force according to the fault current instantaneous breaking required of the circuit.

The armature 24 is a movable member which is capable of rotating to a position approaching the electromagnet member 25 or a position deviating from the electromagnet member 25, with respect to a rotation shaft 24*c* in a center.

Figure 10:
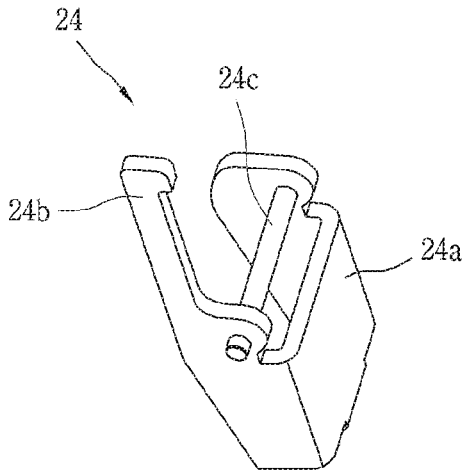
FIG. 10 is a perspective view when only an armature of a trip mechanism part according to an embodiment of the present invention is diagonally seen from an upper side.

The armature 24, as shown in FIG. 10, includes an armature output portion 24*b* and a driving plate portion 24*a*.

As shown in FIG. 10, an assembly of the armature 24 may further include the rotation shaft 24*c*.

The armature output portion 24*b* is a portion which is provided on the armature 24 and rotates to contact and press the crossbar 26.

According to an embodiment, the armature output portion 24*b* may have a shape where an upper end is bent toward the front.

The driving plate portion 24*a* may be provided at a lower portion of the armature 24 as one body with the armature output portion 24*b*. As shown in FIG. 9, the driving plate portion 24*a* is installed to face the electromagnet member 25 and may rotate to a position approaching the electromagnet member 25 or a position deviating from the electromagnet member 25 to rotate the armature output portion 24*b*.

Moreover, the driving plate portion 24*a* can support one end (not referred to by reference numeral, a lower end of the torsion spring in FIG. 9) of the torsion spring 28 by its rear surface (a surface facing the electromagnet member 25).

The torsion spring 28 includes one end (a lower end in FIG. 9) contacting the armature 24 and may be provided as a means which applies an elastic force, returning to a position deviating from the electromagnet member 25, to the armature 24.

The torsion spring 28 includes another end (an upper end in FIG. 9) supported by a spring supporting portion 22*a*2 of the below-described supporting plate 22.

A middle portion of the torsion spring 28 may be installed around the rotation shaft 24*c* and may enable the rotation shaft 24*c* to pass through the middle portion of the torsion spring 28.

According to an embodiment, a pair of torsion springs 28 may be provided. The instantaneous trip mechanism 22, 24, 25, and 28, as shown in FIG. 8 or 9, may further include the supporting plate 22.

Figure 12:
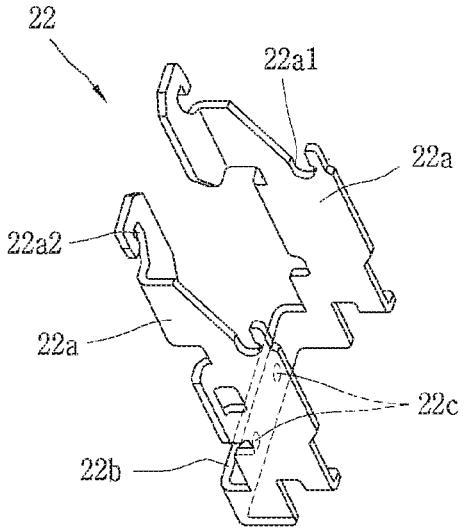
FIG. 12 is a perspective view when only a supporting plate of a trip mechanism part according to an embodiment of the present invention is diagonally seen from an upper side.

According to an embodiment, as shown in FIG. 12, the supporting plate 22 may include a pair of side plate portions 22*a*, the connection portion 22*b*, and the spring supporting portion 22*a*2.

In FIG. 12, reference numeral 22*a*1 refers to as a pair of shaft supporting groove portions as a pair of shaft supporting portions supporting both ends of the rotation shaft 24*c t*, and reference numeral 22*c* refers to a pair of fixing screw hole portions which are provided on the connection portion 22*b* and are spaced apart from each other by an appropriate interval.

As shown in FIG. 12, the pair of side plate portions 22*a* have the shaft supporting groove portions 22*a*1 as a shaft supporting portion supporting the rotation shaft 24*c*.

The pair of side plate portions 22*a* are separated from each other to face each other in a horizontal direction and are symmetrical with each other.

The connection portion 22*b* is provided as a plate-shaped part which has a certain thickness and length to connect the pair of side plate portions 22*a* at lower positions of the pair of side plate portions 22*a*, and may be fixed to any one of a pair of adjacent heaters 21 among four heaters 21, each heater 21 provided for each pole of an electric power source side or an electric load side. Here, a fixing member such as a fixing screw or rivet may pass through the pair of fixing screw hole portions 22*c* and may pass through a pair of through hole portions provided on a lower position of the vertical portion 21*b* of the heater (a terminal) 21 shown in FIG. 4, and by binding the fixing member with a nut or compressing an end of the rivet, the connection portion 22*b* (i.e., the supporting plate 22) may be fixed.

Each of the spring supporting portion 22*a*2 is portion which upward extends from the side plate part 22*a* and is bent vertically, and supports the other end 28*a* of the torsion spring 28.

The spring supporting portion 22*a*2 is provided in a n-shape to restrain an upward displacement of the other end 28*a* of the torsion spring 28, and the spring supporting portion 22*a*2 forms a spring supporting groove portion where an upper portion is closed and a lower portion is opened.

As shown in FIGS. 8 and 9, the thermal trip mechanism 21 and 27 includes the heater 21 and the bimetal 27.

The heater 21 is a terminal for each pole of the DC molded case circuit breaker and is a means which generates heat due to occurrence of an over current on a circuit connected to the DC molded case circuit breaker. Thus, based on the latter function, the heater 21 may be defined as a heater.

The bimetal 27 is coupled to the heater 21, and an upper portion which is a free end portion can be bent by the heater 21 which generates heat due to an over current occurring on the circuit, whereby the bimetal 27 is movable.

Figure 11:
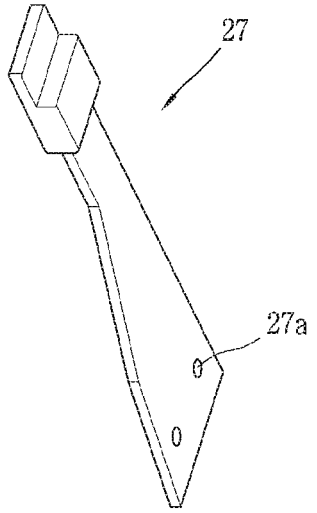
FIG. 11 is a perspective view when only a bimetal of a trip mechanism part according to an embodiment of the present invention is diagonally seen from an upper side.

A whole shape of the bimetal 27 can be seen by referring to FIG. 11, the bimetal 27 may include a pair of through hole portions 27*a* which allows a fixing screw or a rivet to pass through them when a lower portion of the bimetal 27 is fixed to the vertical portion 21*b* of the heater 21.

Figure 14:
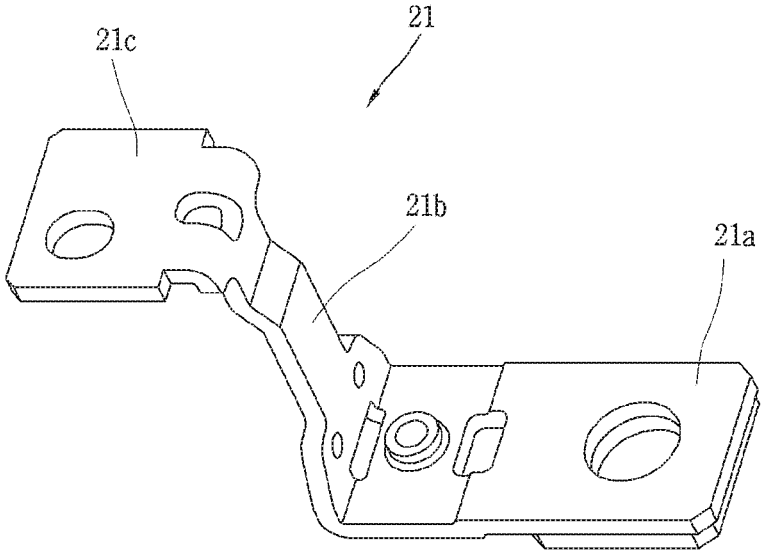
FIG. 14 is a perspective view of only a terminal showing a configuration of a pole where a trip mechanism part is not installed, in a DC molded case circuit breaker including a trip mechanism according to an embodiment of the present invention.

As shown in FIGS. 1 and 3 to 6, only the heater 21 which is formed of an electrical conductor and is a terminal shown in detail in FIG. 14 may be provided in a pole, where the trip mechanism part 20-1 is not installed, of two adjacent poles.

As shown in FIG. 14, as a terminal, the heater 21 may include a terminal portion 21*a*, a middle vertical portion 21*b*, and a connection terminal portion 21*c* connected to the stationary contact or the movable contact.

The terminal portion 21*a* may be connected to the electrical power source side or the electrical load side of the circuit through an external wire or a bus bar.

Moreover, the pair of adjacent terminal portions 21*a* can be connected to a conductor connection member (see 31 of FIGS. 5 to 7) to be described below, and thus, the pair of terminal portions 21*a* corresponding to the same poles can be connected to each other.

Figure 13:
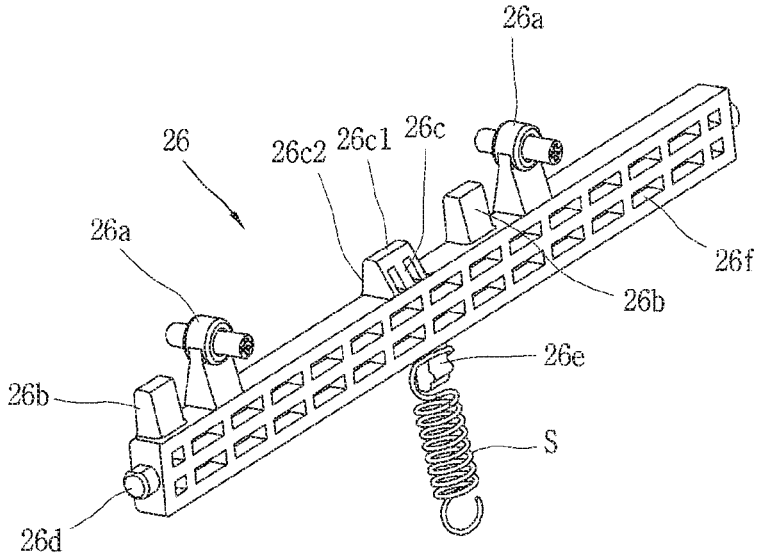
FIG. 13 is a perspective view when a crossbar and a return spring of a trip mechanism part according to an embodiment of the present invention is diagonally seen from an upper side.

The cross bar 26 is a movable member of the instantaneous trip mechanism 22, 24, 25, and 28 and is a means which rotates according to the contacting and pressing of the bimetal 27 of the thermal trip mechanism 21 and 27 or the armature 24. A detailed configuration of the crossbar 26 will be described in detail with reference to FIG. 13.

The crossbar 26 includes a first power receiving portion 26*a*, a second power receiving portion 26*b*, and an output protrusion portion 26*c*.

The first power receiving portion 26*a* is provided in corresponding to the bimetal 27 of the thermal trip mechanism 21 and 27, and is provided to protrude upward from a upper surface of the crossbar 26. The first power receiving portion 26*a* contacts and is pressed by a upper portion on the bimetal 27 which is bent, and thus, is supplied with a pressing force of the bimetal 27.

The second power receiving portion 26*b* is provided in corresponding to a movable member (i.e., the armature 24) of the instantaneous trip mechanism 22, 24, 25, and 28 and may be provided to protrude upward from the upper surface of the crossbar 26. The second power receiving portion 26*b* contacts and is pressed by the armature output portion 24*b* which moves (rotates) clockwise in the drawing, and thus, can be supplied with a pressing force from the movable member (i.e., the armature 24) of the instantaneous trip mechanism 22, 24, 25, and 28.

The output protrusion portion 26*c* is provided to face the shooter ST and is a portion which is provided to protrude upward from the upper surface of the crossbar 26 and provides an output of the crossbar 26 which rotates the shooter ST.

The output protrusion portion 26*c* may include an inclined surface 26*c*2 where a surface facing the shooter ST further protrudes toward the shooter ST in a downward direction.

According to an embodiment, the output protrusion portion 26*c* may be configured with a portion of the cross bar 26 having a trapezoid shaped vertical cross-section, the output protrusion portion 26*c* includes an upper surface 26*c*2 which is a plane, and a front surface and a rear surface which are inclined surfaces.

The crossbar 26 may further include a rotation shaft portion 26*d* provided at both ends in a lengthwise direction.

The trip mechanism 20 for DC molded case circuit breaker according to an embodiment of the present invention may further include a return spring S which returns the crossbar 26 to an original position after a trip operation. The crossbar 26 may further include a return spring supporting protrusion portion 26*e* which is provided to extend downward and supports one end of the return spring S.

Moreover, the crossbar 26 may further include an opening portion 26*f* which is provided in plurality.

The opening portion 26*f* may be configured with a plurality of rectangular opening portions each of which has a horizontally long rectangular shape and the opening portions are provided as a plurality of layers and a plurality of rows.

The crossbar 26 may be formed of an electrical insulating material, and thus, the opening portion 26*f* provided in plurality can effectively prevent occurrence of a defect where the crossbar is bent due to a non-uniform density of materials in cooling after-molding.

A detailed configuration of the shooter ST will be described below with reference to FIGS. 15 to 18.

The shooter ST is provided to rotate according to a contact of the crossbar 26 which rotates, and is a means which provides an output of the trip mechanism.

The shooter ST includes a rotation shaft portion ST2 in a center, an output portion ST1, and a power receiving portion ST3.

The rotation shaft portion ST2 provides a rotation shaft which enables the shooter ST to rotate.

The output portion ST1 may be configured with a bar-shaped portion which is bent downward from the rotation shaft portion ST2, and is a portion which provides an output of the shooter ST while rotating.

The output of the shooter ST allows elements, such as a trip bar (not shown) of the switching mechanism of the above-described DC molded case circuit breaker, to interlock to release a trip spring (not shown) from a latched state, and thus, by using discharging elastic energy of the trip spring, triggers the switching mechanism to operate (a trip operation) in order for a movable contact to be instantaneously separated from a corresponding stationary contact.

The power receiving portion ST3 is a portion which is provided to extend from the rotation shaft portion ST2 toward the crossbar 26 and is supplied with a rotational force from the crossbar 26.

The power receiving portion ST3 may include a plate part having a rectangular vertical cross-sectional shape and a mechanical strength reinforcing portion which is configured with a triangular portion provided on the plate portion.

Figure 16:
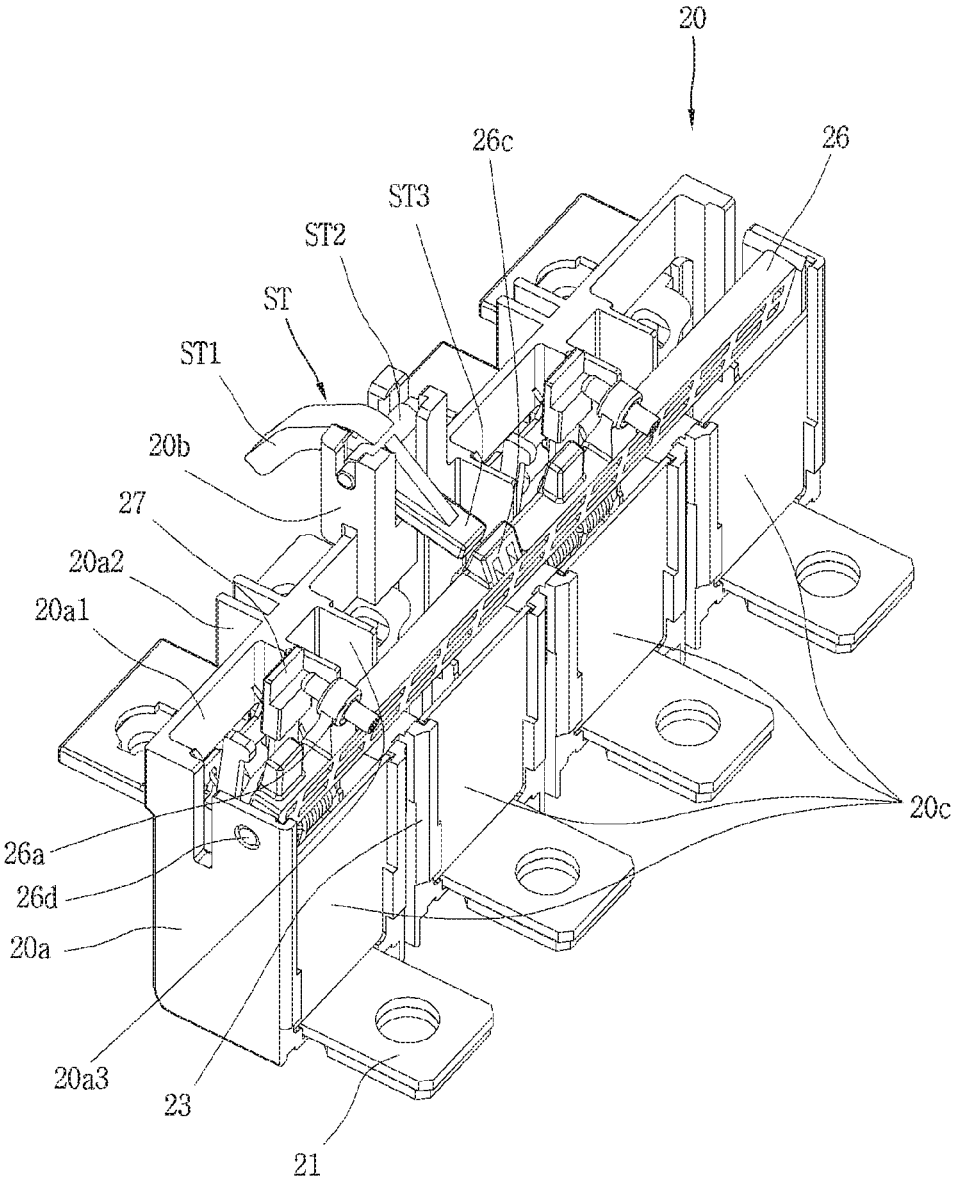
FIG. 16 is a perspective view showing only an assembly of a trip mechanism according to an embodiment of the present invention and is an operating state view showing an after-trip-operation state by an operation of a thermal trip mechanism.

The trip mechanism 20 for DC molded case circuit breaker according to an embodiment of the present invention, as shown in FIG. 15 or 16, may further include an enclosure 20*a* and a shaft receiving member 20*b*.

The enclosure 20*a* accommodates and supports elements configuring the assembly of the trip mechanism 20.

The enclosure 20*a* may include a rear wall portion 20*a*1, which is long provided and where a portion except an opening portion (not shown) allowing the connection terminal portion of the heater 21 for each pole to pass through is closed, and a side wall portion which is bent forward from both ends of the rear wall portion 20*a*1 in a lengthwise direction. The enclosure 20*a* may be formed of an electrical insulating material with a front side opened.

In the enclosure 20*a*, an insulation partition wall 23 may be provided between poles. In the trip mechanism 20 for DC molded case circuit breaker according to an embodiment of the present invention, a trip mechanism part 20-1 may be provided in only one pole of a pair of adjacent poles, and thus, an insulating distance (see dl of FIG. 1) between poles may be the same as a separation distance between the heaters 21 (in the related art, an insulating distance between poles is a distance between two trip mechanisms for a pair of poles, and is narrower than a separation distance between heaters), whereby a thickness of the insulation partition wall 23 can be formed thicker than that of insulation partition wall according to the related art.

According to an embodiment, an inter-pole insulation wall portion 20*a*2 may be provided in plurality on a rear surface of the rear wall portion 20*a*1 to protrude in a backward direction, and a plurality of inter-pole insulation partition wall portions 20*a*3 may be provided on a front surface of the rear wall portion 20*a*1 to protrude in a forward direction.

In FIG. 1, reference numeral 29 refers to an extension insulation partition wall which is connected to extend in the front of the insulation partition wall 23 and is provided for insulation between poles.

The shaft receiving member 20*b* may be provided as one body with the enclosure 20*a* or provided as a separate body to be coupled to the enclosure 20*a*, and supports the rotation shaft portion ST2 of the shooter ST.

According to a preferred embodiment, the shaft receiving member 20*b* is provided with a U-shaped first supporting groove portion which allows the output portion ST1 and the power receiving portion ST3 of the shooter ST to pass through the first supporting groove portion and is provided in a forward-backward direction to support the output portion ST1 and the power receiving portion ST3.

According to a preferred embodiment, a coupling groove portion which is concave toward upper direction and includes an open left surface and an open right surface may be provided under the shaft receiving member 20*b* in order for the rear wall portion 20*a*1 of the enclosure 20*a* to be inserted and installed.

Moreover, according to an embodiment, in order to rotatably support the rotation shaft portion ST2 of the shooter ST, the shaft receiving member 20*b* may further include a pair of U-shaped supporting groove portions which support both ends of the rotation shaft portion ST2.

Figure 17:
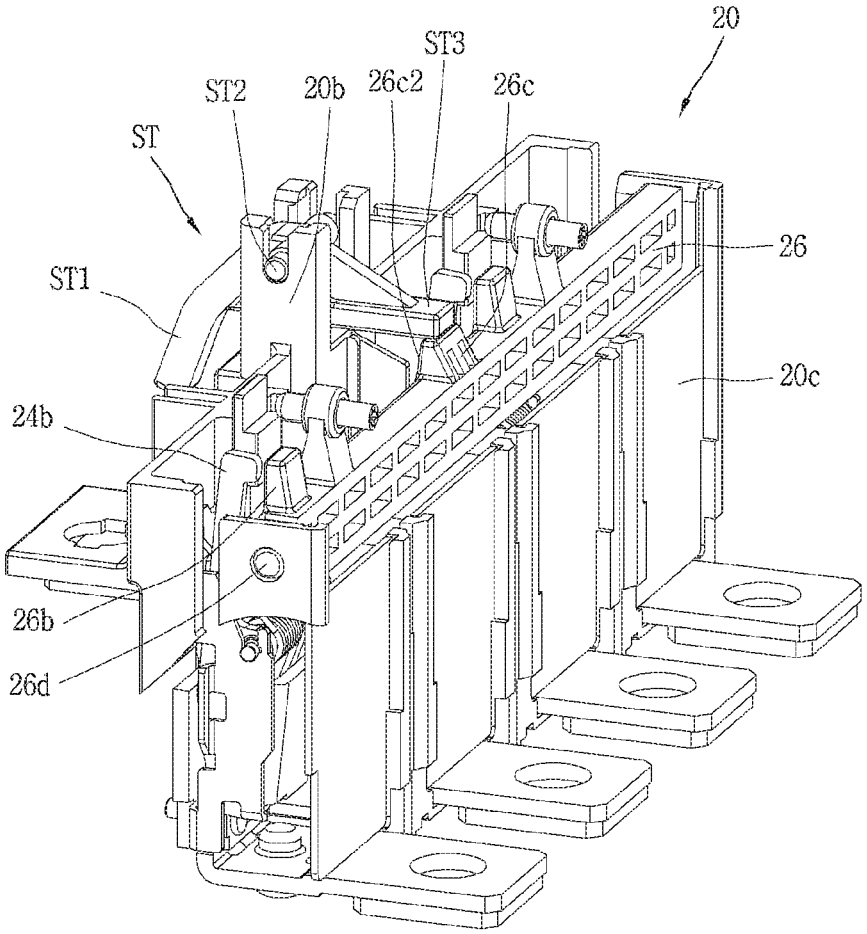
FIG. 17 is a perspective view showing only an assembly of a trip mechanism according to an embodiment of the present invention and is an operating state view showing a before-trip-operation state by an operation of an instantaneous trip mechanism.

As shown in FIGS. 15 to 17, the trip mechanism 20 for DC molded case circuit breaker according to an embodiment of the present invention may further include a plurality of insulation shielding plates 20*c* which prevent a remaining part of the heater 21 except the terminal portion from being exposed to the outside.

The plurality of insulation shielding plates 20*c* may be provided in correspondence with respective poles. According to an embodiment, the plurality of insulation shielding plates 20*c* may be provided as four.

Hereinafter, an example of a circuit diagram and a physical electric connection of a DC molded case circuit breaker where the trip mechanism according to an embodiment of the present invention is installed will be described with reference to FIGS. 5 to 7.

Figure 5:
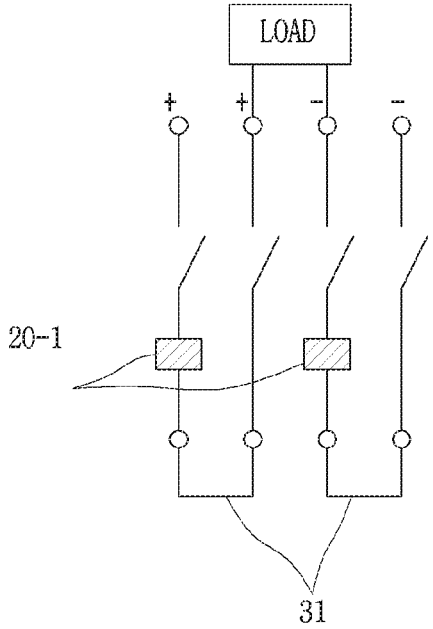
FIG. 5 is a circuit diagram of a DC molded case circuit breaker including a trip mechanism according to an embodiment of the present invention.

As shown in FIG. 5, in the trip mechanism according to the present invention, the trip mechanism part 20-1 including the instantaneous trip mechanism and the thermal trip mechanism may be installed in only one of two adjacent poles. Also, according to an embodiment, one of two conductor connection members 31 is connected between positive terminal portions for the electric power source side and a positive terminal portion for the electric load side, and the other of the two conductor connection members 31 may be connected between negative terminal portions for the electric power source side and a negative terminal portion for the electric load side.

Moreover, as shown in FIG. 5, the switching mechanism for each pole (not referred to by reference numeral) including the movable contact and the stationary contact may be provided as two between the positive terminal portion for the electric power source side and the positive terminal portion for the electric load side. Also, the switching mechanism for each pole (not referred to by reference numeral) including the movable contact and the stationary contact may be provided as two between the negative terminal portion for the electric power source side and the negative terminal portion for the electric load side.

In the switching mechanism, as well known, a plurality of poles may be simultaneously switched by a switching shaft (not shown) which are in the plurality of poles in common.

Figure 6:
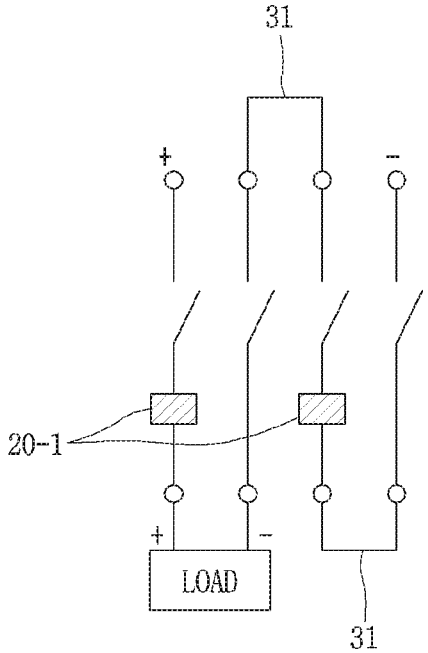
FIG. 6 is a circuit diagram of a DC molded case circuit breaker including a trip mechanism according to another embodiment of the present invention.

As shown in FIG. 6, in the trip mechanism according to the present invention, the trip mechanism part 20-1 including the instantaneous trip mechanism and the thermal trip mechanism may be installed in only one of two adjacent poles. Also, according to another embodiment, the two conductor connection members 31 may be connected between the negative terminal portion for the electric power source side and the negative terminal portion for the electric load side.

Moreover, as shown in FIG. 6, the switching mechanism (not referred to by reference numeral) including the movable contact and the stationary contact may be provided between the positive terminal portion for the electric power source side and the positive terminal portion for the electric load side and between the negative terminal portion for the electric power source side and the negative terminal portion for the electric load side, and provided as four.

In the switching mechanism, as well known, a plurality of poles may be simultaneously switched by a switching shaft (not shown) which are in the plurality of poles in common.

As shown in FIG. 7, the conductor connection member 31 may be provided as a conductor plate having an approximate U-shape and can electrically connect terminals for the same pole.

As shown in FIG. 7, in the DC molded case circuit breaker 200, the bus bar 33 which provides a conductive path which generates small amount of heat may be connected to the heater (the terminal), for a connection between a circuit for the power source and a circuit for the load, and an inter-pole insulation plate 32 for insulation between poles may be installed between adjacent bus bars 33.

Moreover, the inter-pole insulation plate 32 for insulation between poles may be installed between two adjacent conductor connection members 31.

An operation of the trip mechanism for DC molded case circuit breaker according to an embodiment of the present invention, configured as described above, will be described with primary reference to FIGS. 15 to 18 and with secondary reference to FIGS. 8 to 9.

First, a thermal trip operation of the trip mechanism 20 for DC molded case circuit breaker according to an embodiment of the present invention will be described.

For example, when an over current corresponding to 120% of a rating current occurs on a circuit where the DC molded case circuit breaker is connected, an upper portion of the bimetal 27 moves by bending according to heat generated from the heater 21, and in a state shown in FIG. 15, contacts and presses (i.e., push) the first power receiving portion 26*a* of the crossbar 26 installed to face the bimetal 27.

Then, the crossbar 26 provided as one body with the first power receiving portion 26*a* rotates clockwise together with the rotation shaft portion 26*d*.

From a before-rotation state (i.e., the state shown in FIG. 15) at which the power receiving portion ST3 of the shooter ST located on the upper surface of the output protrusion portion 26*c* in the crossbar 26 may be downward pushed according to the output protrusion portion 26*c* contacting a lower portion of the inclined surface (see 26*c*2 of FIG. 13), and thus, the shooter ST may rotate clockwise in the drawing along with the rotation shaft portion ST2, whereby the output portion ST1 of the shooter ST may be put in a state where a free end portion of the output portion ST1 has been raised as shown in FIG. 16.

The displacement of the output portion ST1 of the shooter ST, as described above, allows elements, such as a trip bar (not shown) of a switching mechanism of the above-described DC molded case circuit breaker, to interlock to release a trip spring (not shown) in a restrained state (latched state), and thus, by using discharging elastic energy of the trip spring, triggers the switching mechanism to operate (a trip operation) in order for a movable contact to be instantaneously separated from a corresponding stationary contact.

An instantaneous trip operation of the trip mechanism 20 for DC molded case circuit breaker according to an embodiment of the present invention will be described.

In the circuit where the DC molded case circuit breaker is installed, for example, when a fault current such as an electric shortage current which is several to tens times a rating current occurs, as shown in FIG. 8 or 9, the electromagnet 25 is magnetized, and thus, a magnetic attractive force is generated, thereby allowing the driving plate portion 24*a* and the armature output portion 24*b* of the armature 24 to rotate clockwise.

Therefore, as the armature output portion 24*b* rotates clockwise, the armature output portion 24*b* contacts and presses (i.e., push) the second power receiving portion 26*b* of the crossbar 26 installed to face the armature output portion 24*b* in a state shown in FIG. 17.

Then, the crossbar 26 provided as one body with the second power receiving portion 26*b* rotates clockwise together with the rotation shaft portion 26*d*.

Figure 18:
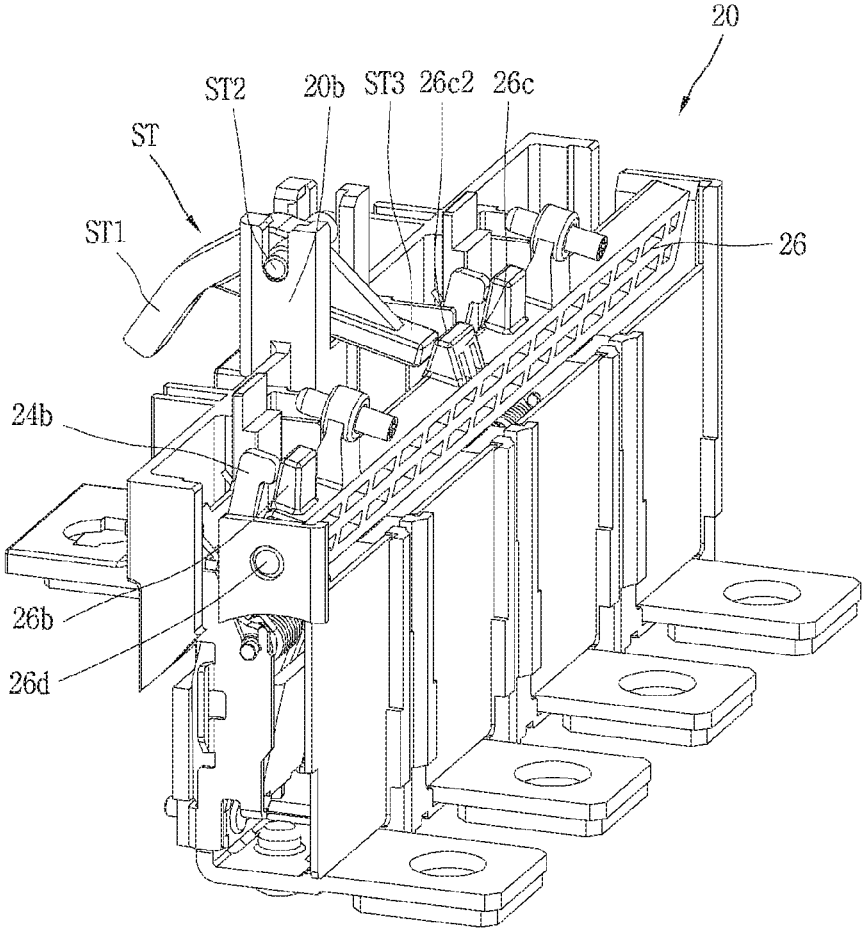
FIG. 18 is a perspective view showing only an assembly of a trip mechanism according to an embodiment of the present invention and is an operating state view showing an after-trip-operation state by an operation of an instantaneous trip mechanism.

From a before-rotation state (i.e., the state shown in FIG. 17), the power receiving portion ST3 of the shooter ST located on the upper surface of the output protrusion portion 26*c* in the crossbar 26 may be downward pushed according to the output protrusion portion 26*c* contacting a lower portion of the inclined surface (see 26*c*2 of FIG. 13), and thus, the shooter ST may rotate clockwise in the drawing along with the rotation shaft portion ST2, whereby the output portion ST1 of the shooter ST is put in a state where the free end portion of the output portion ST1 has been raised as shown in FIG. 18.

The displacement of the output portion ST1 of the shooter ST, as described above, allows elements, such as a trip bar (not shown) of a switching mechanism of the above-described DC molded case circuit breaker, to interlock to release a trip spring (not shown) in a restrained state, and thus, by using discharging elastic energy of the trip spring, triggers the switching mechanism to operate (a trip operation) in order for a movable contact to be instantaneously separated from a corresponding stationary contact.

As described above, the over current trip operation and the instantaneous trip operation of the trip mechanism 20 for DC molded case circuit breaker according to an embodiment of the present invention can be accomplished.

The technical effect of the trip mechanism for DC molded case circuit breaker according to the present invention will be described as follows.

In the trip mechanism for DC molded case circuit breaker according to an embodiment of the present invention, since the trip mechanism part including the instantaneous trip mechanism and the thermal trip mechanism is provided in only one of two adjacent poles, an insulating distance between the two adjacent poles is enlarged in comparison with the related art where the trip mechanism part is installed in all of two adjacent poles and an insulating distance between two trip mechanism parts is reduced due to a portion protruding in a lateral direction. Also, in order to secure an insulating distance between poles, it is not required to enlarge a width of the DC molded case circuit breaker, and thus, a size (a width) of the DC molded case circuit breaker does not increase.

In the trip mechanism for DC molded case circuit breaker according to the present invention, the crossbar includes a first power receiving portion being supplied with a pressing force of the bimetal; a second power receiving portion being supplied with a pressing force from the movable member of the instantaneous trip mechanism; and an output protrusion portion providing an output of the crossbar which rotates the shooter. Accordingly, the crossbar may receive a rotational force from the thermal trip mechanism through the first power receiving portion or receive a rotational force from the instantaneous trip mechanism through the second power receiving portion to rotate, thereby providing an output for rotating the shooter through the output protrusion portion.

In the trip mechanism for DC molded case circuit breaker according to the present invention, the output protrusion portion may include an inclined surface where a surface facing the shooter further protrudes toward the shooter in a downward direction. Accordingly, when the crossbar rotates, a lower portion of the inclined surface contact the shooter, and the shooter can rotate in the same direction as the crossbar.

The trip mechanism for DC molded case circuit breaker according to the present invention further include a return spring returning the crossbar to an original position, wherein the crossbar may further include a return spring supporting protrusion portion provided to extend downward, the return spring supporting protrusion portion supporting one end of the return spring. Accordingly, if a driving force for rotating the crossbar is removed after the trip operation, the crossbar can return to an original position by the return spring, an elastic force of the return spring can be applied to the crossbar by the return spring supporting protrusion portion, and one end of the return spring can be supported.

In the trip mechanism for DC molded case circuit breaker according to the present invention, the shooter includes: a rotation shaft portion in a center; an output portion provided to be bent downward from the rotation shaft portion, the output portion providing an output of the shooter while rotating; and a power receiving portion provided to extend from the rotation shaft portion to the crossbar, the power receiving portion being supplied with a rotational force from the crossbar. Accordingly, the shooter can provide an output for trip through the output portion while rotating and receive a rotational force from the crossbar through the power receiving portion.

The trip mechanism for DC molded case circuit breaker according to the present invention further included: an enclosure; and a shaft receiving member provided as one body in the enclosure or provided as a separate body to be coupled to the enclosure, the shaft receiving member supporting the rotation shaft portion. Accordingly, elements configuring the trip mechanism may be accommodated into the enclosure, and the shaft receiving member may rotatably support the rotation shaft portion of the shooter through the shaft receiving member.

In the trip mechanism for DC molded case circuit breaker according to the present invention, the thermal trip mechanism includes a heater and the bimetal, and the instantaneous trip mechanism includes an electromagnet member, an armature, and a torsion spring. Accordingly, when an over current occurs in the circuit, a driving force for rotating the crossbar can be provided by an operation of the thermal trip mechanism, and when a fault current instantaneous breaking required occurs in the circuit, a driving force for rotating the crossbar can be provided by the instantaneous trip mechanism. When the fault current instantaneous breaking required is removed, the armature can return to a position deviating from the electromagnet member by using the torsion spring.

The trip mechanism for DC molded case circuit breaker according to the present invention further includes a supporting plate, wherein the supporting plate includes a pair of side plate portions, a connection portion, and a spring supporting portion. Accordingly, the rotation shaft of the armature can be supported by the side plate part, the pair of side plate portions can be fixed to the heater through the connection portion, and one end of the torsion spring can be supported by the spring supporting portion.

In the trip mechanism for DC molded case circuit breaker according to the present invention, the armature includes an armature output portion, and a driving plate portion provided in a lower portion as one body with the armature output portion and installed to face the electromagnet member to rotate to a position approaching the electromagnet member or a position deviating from the electromagnet member to rotate the armature output portion, the driving plate portion supporting one end of the torsion spring. Accordingly, when the driving plate portion rotates to a position approaching the electromagnet member with a magnetic attractive force, the armature output portion can rotate in the same direction as the driving plate portion.

In the trip mechanism for DC molded case circuit breaker according to the present invention, only a terminal including an electrical conductor is provided in a pole, where the trip mechanism part is not installed, of two adjacent poles. Accordingly, an insulating distance between two adjacent poles increases from a distance between trip mechanisms to a distance between terminals.

The trip mechanism for DC molded case circuit breaker according to the present invention further includes an inter-pole insulation partition wall having a thickness equal to a distance between heaters for a pair of adjacent poles. Accordingly, a thickness of the inter-pole insulation partition wall increases in comparison with the related art where the thickness of the inter-pole insulation partition wall is less than a distance between heaters.

The trip mechanism for DC molded case circuit breaker according to the present invention further includes a bus bar connected to a heater for each pole; and an inter-pole insulation plate provided between a pair of adjacent bus bars, for insulation between poles. Accordingly, heat is reduced due to an increase in area of a conductive path, and inter-pole insulation between bus bars can be achieved.

What is claimed is:

1. A trip mechanism for a direct current (DC) molded case circuit breaker, the trip mechanism comprising:

a trip mechanism part including an instantaneous trip mechanism connected to a circuit, the instantaneous trip mechanism including a movable member to operate according to a fault current instantaneous breaking required which flows on the circuit, and a thermal trip mechanism connected to the circuit, the thermal trip mechanism including a bimetal to operate according to an over current flowing on the circuit, the trip mechanism part being provided for one of two adjacent poles;

a crossbar that is rotatable by contacting and pressing of the movable member of the instantaneous trip mechanism or the bimetal of the thermal trip mechanism; and a shooter that is provided to be rotatable by contacting of the crossbar rotating, the shooter provides an output of the trip mechanism, wherein the cross bar comprises:

a first power receiving portion that is provided in corresponding to the bimetal of the thermal trip mechanism, the first power receiving portion formed to protrude upwardly, and the first power receiving portion receiving a pressing force from the bimetal;

a second power receiving portion that is provided in corresponding to the movable member of the instantaneous trip mechanism, the second power receiving portion formed to protrude upwardly, and the second power receiving portion receiving a pressing force from the movable member of the instantaneous trip mechanism; and an output protrusion portion that is provided to face the shooter and provided to protrude upwardly from the crossbar, the output protrusion portion providing an output of the crossbar which drives the shooter to rotate.

2. The trip mechanism of claim 1, wherein the output protrusion portion is configured with an inclined surface facing the shooter, the inclined surface facing the shooter further protrudes toward the shooter in a downward direction.

3. The trip mechanism of claim 1, further comprising: a return spring that returns the crossbar to an original position, wherein the crossbar further comprises a return spring supporting protrusion portion that is provided to extend downward, the return spring supporting protrusion portion supporting one end of the return spring.

4. The trip mechanism of claim 1, wherein the shooter comprises:

a rotation shaft portion in a center;

an output portion provided to be bent downward from the rotation shaft portion, the output portion providing an output of the shooter while rotating; and a power receiving portion provided to extend from the rotation shaft portion toward the crossbar, the power receiving portion being supplied with a rotational force from the crossbar.

5. The trip mechanism of claim 4, further comprising:

an enclosure; and a shaft receiving member that is provided as one body in the enclosure or provided as a separate body to be coupled to the enclosure, the shaft receiving member supporting the rotation shaft portion.

6. The trip mechanism of claim 1, wherein the thermal trip mechanism comprises:

a heater that generates heat according to an over current occurring on the circuit, the heater being a terminal portion; and the bimetal coupled to the heater and bent by the heater generating the heat, and the instantaneous trip mechanism comprises:

an electromagnet member electrically connected to the heater to provide a magnetic attractive force according to the fault current instantaneous breaking required of the circuit;

an armature, the armature being a movable member capable of rotating around a rotation shaft to a position approaching the electromagnet member or a position deviating from the electromagnet member; and a torsion spring including one end contacting the armature, the torsion spring applying an elastic force, returning to a position deviating from the electromagnet member, to the armature.

7. The trip mechanism of claim 6, the instantaneous trip mechanism further comprising a supporting plate, wherein the supporting plate comprises:

a pair of side plate portions that include a shaft supporting portion supporting the rotation shaft;

a connection portion that is fixed to the heater and connects the pair of side plate portions; and a pair of spring supporting portions that are provided to extend from the pair of side plate portions, the pair of spring supporting portions supporting another end of the torsion spring.

8. The trip mechanism of claim 6, wherein the armature comprises:

an armature output portion provided on an upper part of the armature to contact and press the crossbar while rotating; and a driving plate portion provided in a lower part of the armature as one body with the armature output portion and installed to face the electromagnet member to rotate to a position approaching the electromagnet member or a position deviating from the electromagnet member to rotate the armature output portion, the driving plate portion supporting the one end of the torsion spring.

9. The trip mechanism of claim 1, wherein a terminal including an electrical conductor is provided in a pole, where the trip mechanism part is not installed, of the two adjacent poles.

10. The trip mechanism of claim 1, further comprising: an inter-pole insulation partition wall having a thickness equal to a distance between heaters for a pair of adjacent poles.

11. The trip mechanism of claim 1, further comprising:

a bus bar connected to a heater for each pole; and an inter-pole insulation plate provided between a pair of adjacent bus bars, for insulation between poles.

12. The trip mechanism of claim 1, wherein the trip mechanism part is provided as two in one DC molded case circuit breaker.

* * * * *